US007500730B2

(12) United States Patent
Nishida et al.

(10) Patent No.: US 7,500,730 B2
(45) Date of Patent: Mar. 10, 2009

(54) INKJET RECORDING APPARATUS

(75) Inventors: Katsunori Nishida, Togo-cho (JP); Tomoyuki Kubo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 362 days.

(21) Appl. No.: 11/073,546

(22) Filed: Mar. 8, 2005

(65) Prior Publication Data

US 2005/0212860 A1 Sep. 29, 2005

(30) Foreign Application Priority Data

Mar. 26, 2004 (JP) ..... 2004-093148

(51) Int. Cl.
*B41J 29/377* (2006.01)

(52) U.S. Cl. ..... 347/18; 347/17; 347/67; 347/87

(58) Field of Classification Search ..... 347/67, 347/62, 6, 61, 18, 17, 14, 86, 87
See application file for complete search history.

(56) References Cited

U.S. PATENT DOCUMENTS 5,587,882 A * 12/1996 Patel ..... 361/705
6,019,457 A * 2/2000 Silverbrook ..... 347/65
6,281,914 B1 * 8/2001 Hiwada et al. ..... 347/50
6,334,668 B1 * 1/2002 Isamoto ..... 347/57
2002/0105567 A1 * 8/2002 Yamada et al. ..... 347/87
2003/0063449 A1 4/2003 Suzuki et al.

FOREIGN PATENT DOCUMENTS

JP A 2003-80793 3/2003

* cited by examiner

*Primary Examiner*—Matthew Luu
*Assistant Examiner*—Henok Legesse
(74) *Attorney, Agent, or Firm*—Oliff & Berridge, PLC

(57) ABSTRACT

There is disclosed an inkjet recording apparatus which comprises a head having an actuator and at least one nozzle row each of which comprises a plurality of nozzles for ejecting an ink droplet therethrough onto a recording medium by driving of the actuator, a drive element which outputs to the actuator a drive signal for ejecting the ink droplet, an ink supply portion which is connected to the head so as to supply ink to the head, a heat radiating member which has a contact portion in contact with the drive element and an extending portion disposed alongside at least a part of the ink supply portion so as to release heat generated at the drive element, and a head holder which holds the head, the drive element, ink supply portion, and the heat radiating member.

19 Claims, 8 Drawing Sheets

RELATED ART

INKJET RECORDING APPARATUS

INCORPORATION BY REFERENCE

The present application is based on Japanese Patent Application No. 2004-093148, filed on Mar. 26, 2004, the content of which is incorporated herein by reference.

BACKGROUND OF THE INVENTION

1. Field of the Invention

The invention relates to an inkjet recording apparatus in which an ink droplet is ejected from each of nozzles onto a recording medium.

2. Description of Related Art

As this kind of inkjet recording apparatus, there is known an apparatus where an actuator unit, such as an electromechanical transducer, e.g., a piezoelectric element, and an electrothermal transducer, is driven to vary the pressure in a pressure chamber in communication with one of nozzles so as to eject ink in the pressure chamber through the nozzle onto a recording medium, thereby performing printing.

Conventional inkjet recording apparatuses of this kind are classified into two groups based on the relative size difference between the actuator unit and the recording medium. Namely, a fixed-head type in which the recording medium is moved relatively to the actuator unit when printing is performed, and a serial type in which the actuator unit is also moved relatively to the recording medium when printing is performed. FIG. 8 presents a part of an inkjet recording apparatus of the latter type as disclosed in JP-A-2003-80793 corresponding to U.S. patent application Publication No. 2003063449A1 where a head holder holding a recording head 80 is mounted on a carriage. In FIG. 8 is presented a positional relationship between the head 80 on the head holder and an IC chip 84, as seen from the side of a nozzle surface 81 in which a plurality of nozzles are formed.

More specifically, the head 80 has the nozzle surface 81 in which the nozzles are open. The head 80 is generally rectangular and the nozzles are arranged in a plurality of rows or groups each extending along a longitudinal direction of the head 80. The number of the nozzle rows corresponds to the number of inks of respective colors used, and the nozzle rows are aligned in a width direction of the head 80 which is perpendicular to the longitudinal direction. In the head 80, there are formed ink supply ports 86*a*-86*d* at a position corresponding to ends of the respective nozzle rows on a same side in the direction of extension of each nozzle row. There is formed an ink supply passage which extends from an ink cartridge mounted on an upper, open side of the head holder, to the ink supply ports 86*a*-86*d* of the head 80, and includes an ink supply channel formed through the head holder.

At the side of the ones of the opposite ends of the respective nozzle rows which are remote from the ink supply ports 86*a*-86*d*, there is disposed an IC chip 84 having a drive circuit for outputting drive signals for driving an actuator unit disposed on a surface of the head opposite to the nozzle surface.

The IC chip 84 is long and disposed along the width direction of the head 80. On an upper surface of the IC chip 84, a heatsink 83 for releasing heat generated at the IC chip 84 is disposed. The heatsink 83 has a horizontally long, planar shape whose plane surface has an area larger than that of the upper surface of the IC chip 84, and is fixed to a wall surface of the head holder which is on a side opposite the ink supply ports of the head 80.

An ink ejection performance, including the speed at which ink droplets are ejected, varies with the viscosity of the ink, which in turn varies with the temperature of the ink. That is, a change in the ink temperature leads to a change in the ink ejection performance.

However, in the conventional inkjet recording apparatus as shown in FIG. 8, the heatsink 83 is disposed positionally correspondingly to the ends of the respective nozzle rows on the side remote from the ink supply ports 86*a*-86*d*. Hence, the temperature of the head body 80 is the highest at an area corresponding to the ends of the nozzle rows remote from the ink supply ports 86*a*-86*d*, and gradually decreases toward the ink supply ports 86*a*-86*d*. Since the temperature is decreased around the ink supply ports 86*a*-86*d* by the unwarmed ink flowing through the ink supply ports 86*a*-86*d*, the temperature at this place is further lowered.

Accordingly, in the nozzle surface 81, a variation in the temperature of the ink may occur, leading to a variation in the ink ejecting performance among nozzles depending upon their positions, namely, whether near the ink supply ports or the IC chip 84. This can cause deterioration in the quality of an image formed on the recording medium.

In particular, there has been recently a growing demand for an inkjet recording apparatus assuring a further enhanced recording quality and higher recording rate, resulting in the existing tendency of increasing the number of nozzles and shortening the interval of applications of the drive signals. This considerably raises the temperature of the IC chip 84, and an adverse influence of this rise in temperature on the recording quality has now become a matter of concern.

SUMMARY OF THE INVENTION

The present invention has been developed in view of the above-described situations and it is an object of the invention to provide an inkjet recording apparatus capable of reducing the variation in temperature in a region where the nozzles are disposed.

To attain the above object, the invention provides an inkjet recording apparatus which comprises: a head having an actuator and at least one nozzle row each of which comprises a plurality of nozzles for ejecting an ink droplet therethrough onto a recording medium by driving the actuator; a drive element which outputs to the actuator a drive signal for ejecting the ink droplet; an ink supply portion which is connected to the head so as to supply ink to the head; a heat radiating member which has a contact portion in contact with the drive element and an extending portion disposed along at least a part of the ink supply portion, so as to release heat generated at the drive element; and a head holder which holds the head, the drive element, the ink supply portion, and the heat radiating member.

According to this arrangement, the ink which is to be ejected in the form of droplets from the nozzles formed in the head is warmed by the heat radiated from the heat radiating member, before the ink is supplied to the head. Thus, there can be reduced the variation in the temperature of the ink in the region where the nozzles are disposed, that is, the variation in the ink temperature from nozzle to nozzle, making the ink ejection performance uniform in the region. In addition, the heat radiated from the heat radiating member is drawn by the ink in the ink supply portion, through a part of the ink supply portion alongside which the heat radiating member extends, enhancing the efficiency of heat radiation.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described presently preferred embodiments of the invention, by referring to FIGS. 1 to 5.

<General Structure of Inkjet Recording Apparatus>

Figure 1:
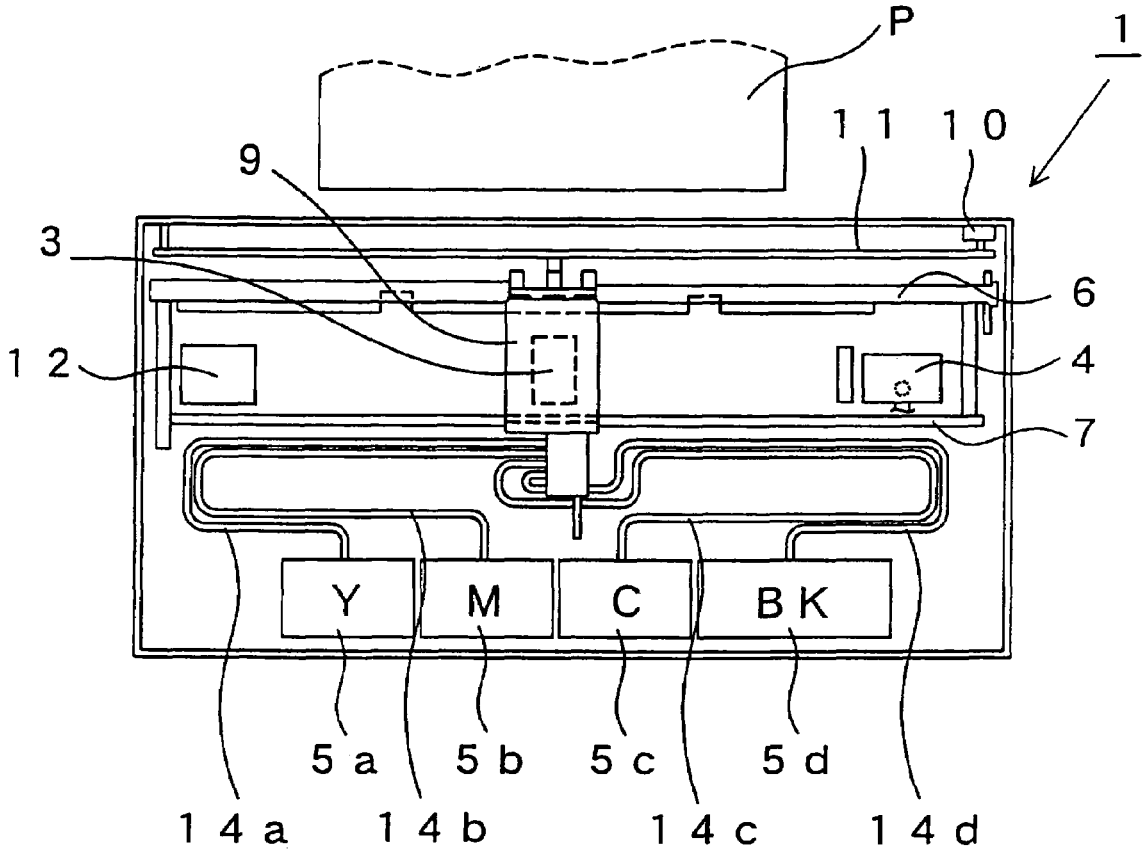
FIG. 1 is a plan explanatory view of an inkjet recording apparatus according to a first embodiment of the invention.
Figure 2:
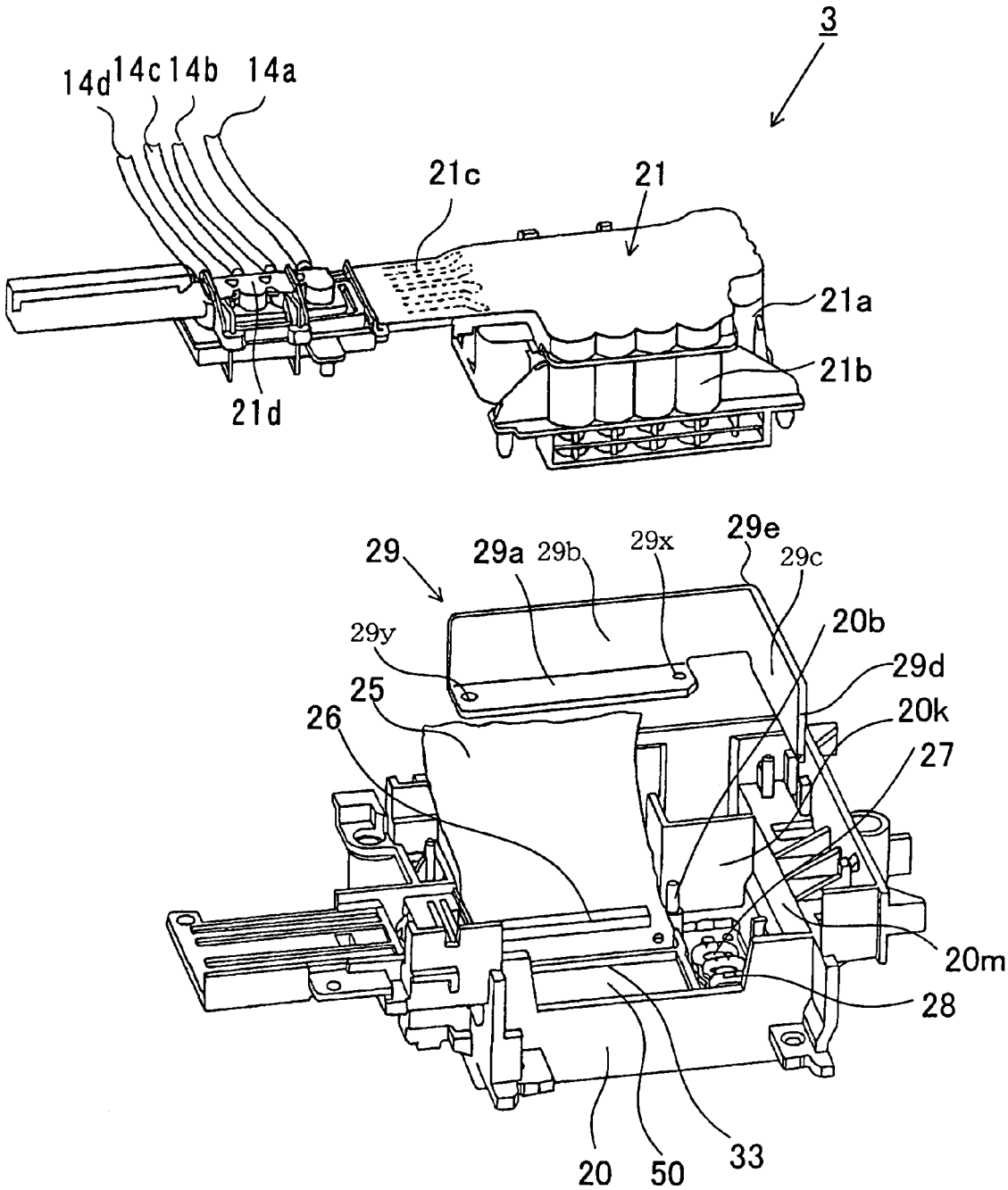
FIG. 2 is an exploded perspective view of an inkjet head of the inkjet recording apparatus shown in FIG. 1.
Figure 3:
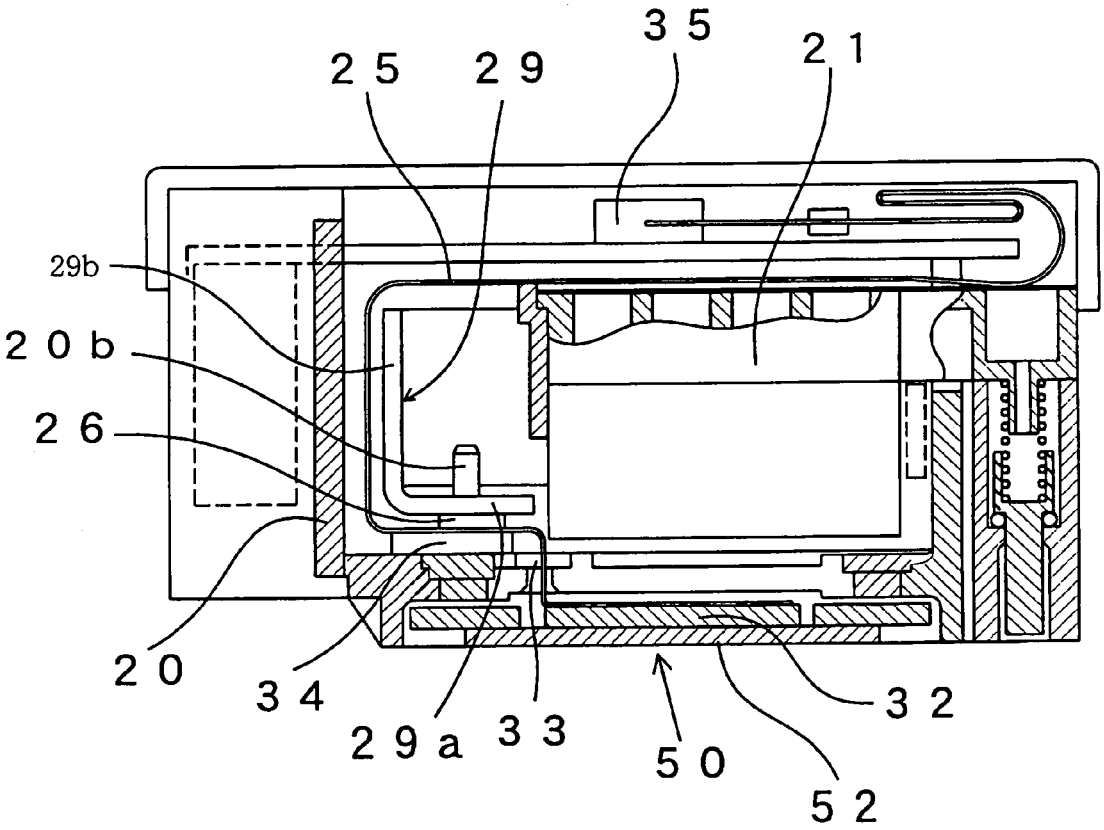
FIG. 3 is a longitudinal cross-sectional view illustrating the inkjet head of FIG. 2.
Figure 4:
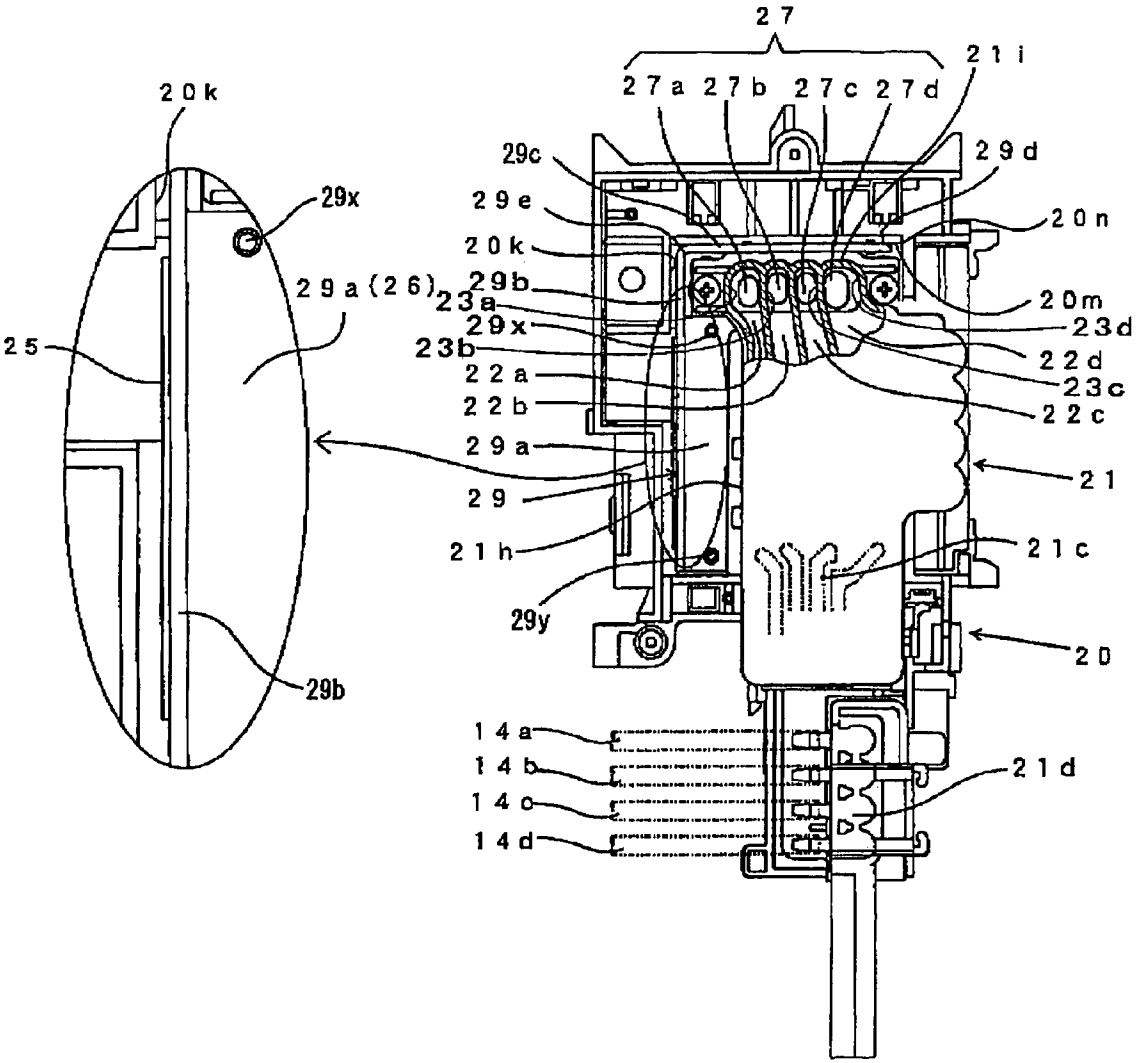
FIG. 4 is a plan explanatory view showing a part of an inner structure of the inkjet head.
Figure 5:
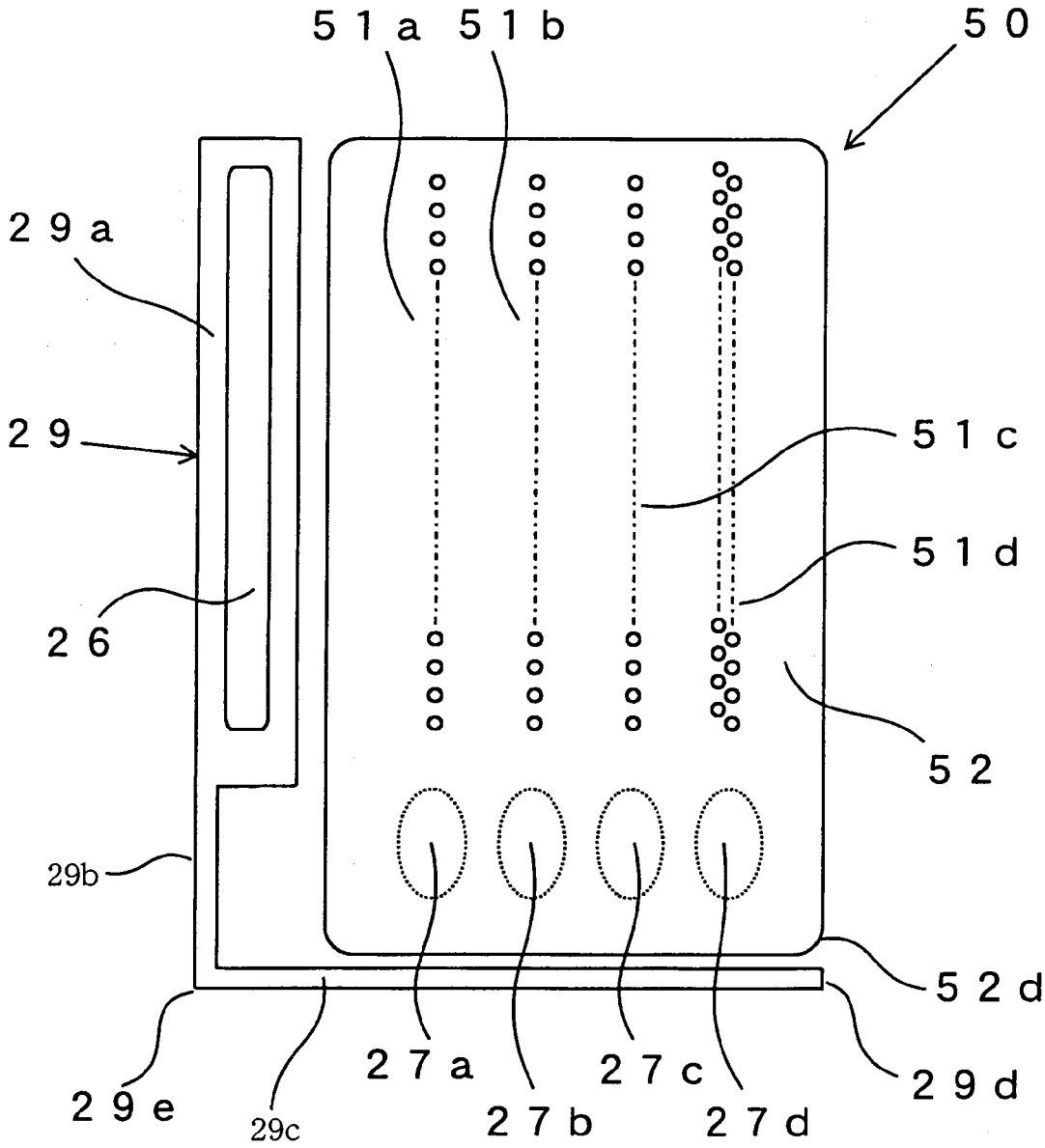
FIG. 5 is an explanatory view of the inkjet head as seen from the side of a nozzle surface.

FIG. 1 is a plan explanatory view of an inkjet recording apparatus according to a first embodiment of the invention, and FIG. 2 is an exploded perspective view of a head unit of the inkjet recording apparatus of FIG. 1. FIG. 3 is a longitudinal cross-sectional view illustrating the head unit of FIG. 2, and FIG. 4 is a plan explanatory view showing a part of an inner structure of the head unit. FIG. 5 is an explanatory view of the head unit as seen from the side of a nozzle surface.

Referring to FIG. 1, inside the inkjet recording apparatus 1 are disposed two guide rods 6, 7 on which a carriage 9 is mounted movably along the guide rods 6, 7. To perform printing, a head unit 3 mounted on the carriage 9 ejects ink droplets onto a recording sheet P. The carriage 9 is attached to an endless belt 11 which is circulated by a motor 10, so as to be movable along the guide rods 6, 7 by operation of the motor 10.

In the inkjet recording apparatus 1, there are disposed ink tanks 5*a*, 5*b*, 5*c*, 5*d* accommodating yellow ink, magenta ink, cyan ink, and black ink, respectively. The ink tanks 5*a*-5*d* are connected to the head unit 3 through respective flexible ink supply tubes 14*a*, 14*b*, 14*c*, 14*d*, such that color inks used at the head unit 3 are supplied from the ink tanks via the ink supply tubes 14*a*-14*d*.

At a position corresponding to one of opposite ends of a reciprocating motion of the carriage 9, a flushing unit 12 is disposed, while at a position corresponding to the other end of the reciprocating motion a maintenance unit 4 is disposed. The head unit 3 discharges bad ink including bubbles and/or others, to the flushing unit 12, in order to keep its ink ejection performance excellent. At the maintenance unit 4, the head unit 3 is subjected to maintenance operations, such as sucking ink including bubbles and wiping the nozzle surface, so that the ink ejection performance is kept excellent.

<General Structure of Inkjet Head>

There will be now described a general structure of the head unit 3. Hereinafter, a surface of the head unit 3 shown in FIG. 4 is referred to as an upper surface thereof, while the nozzle surface as shown in FIG. 5 is referred to as a lower surface or bottom of the head unit 3.

As shown in FIG. 2, the head unit 3 includes a head holder 20 on whose bottom a head 50 is attached from the outside, with its nozzle surface 52 (as shown in FIG. 5) facing downward. On the upper side of the head 50, a buffer tank 21 for storing the inks to be supplied to the head 50 is mounted. The ink supply tubes 14*a*-14*d* are connected to an end of the buffer tank 21 via a tube joint 21*d*. The buffer tank 21 contains an amount of air, which functions to alleviate the impact force accompanying a start or stop of a movement of the head unit 3, thereby preventing a variation in the pressure in each of pressure chambers in the head 50. The air in the buffer tank 21 thus serves to keep uniform the ink ejection performance at each nozzle.

The buffer tank 21 comprises a buffer chamber 21*a* for storing the color inks separately in respective compartments 22*a*, 22*b*, 22*c*, 22*d*, and an exhaust portion 21*b* for discharging the air in the buffer chamber 21*a*. When the inks in the buffer chamber 21*a* are consumed by being ejected from the head 50, the inside pressure of the compartments 22*a*-22*d* of the buffer chamber 21*a* is made negative, thereby the inks in the ink tanks 5*a*-5*d* being supplied to the buffer tank 21 through the ink supply tubes 14*a*-14*d*, the tube joint 21*d*, and an ink passage 21*c*.

As shown in FIG. 4 and mentioned above, the buffer chamber 21*a* comprises four compartments 22*a*, 22*b*, 22*c*, 22*d* for yellow, magenta, cyan, and black inks, respectively, which are arranged in the order of description from the side of an IC chip 26 as a drive circuit; and four ink lead passages 23*a*, 23*b*, 23*c*, 23*d* that communicate, at respective one ends thereof, with the four compartments 22*a*, 22*b*, 22*c*, 22*d*, respectively, and communicate, at respective one ends thereof, with four ink supply ports 27 (27*a*, 27*b*, 27*c*, 27*d*, described below) of the head 50, respectively. Since the black ink is consumed in the largest amount among the four inks, the volume of the compartment 22*d* for black ink is made larger than that of the other compartments 22*a*-22*c* for inks of the other colors.

As shown in FIG. 2, the head 50 has ink supply ports 27 through which the inks from the buffer chamber 21*a* are supplied. The ink supply ports are arranged in a row; more specifically, an yellow ink supply port 27*a*, a magenta ink supply port 27*b*, a cyan ink supply port 27*c*, and a black ink supply port 27*d*, each of which is an oblong opening, are disposed correspondingly to the compartments 22*a*-22*d* for inks of the respective colors, as shown in FIG. 4. Each of the ink supply ports 27 is connected to the buffer chamber 21*a* via a sealing member 28, which seals in its compressed state the connection between the ink supply port 27 and the buffer chamber 21*a* in order to prevent leakage of the ink therefrom.

As shown in FIG. 5, the head 50 is rectangular and has the nozzle surface 52 in which are formed a nozzle row 51*a* for yellow ink, a nozzle row 51*b* for magenta ink, a nozzle row 51*c* for cyan ink, and two nozzle rows 51*d* for black ink. The ink supply ports 27*a*-27*d* for therethrough supplying the inks to the nozzles are formed upstream of the nozzles with respect to supply of the inks, and in the vicinity of ends of the respective nozzle rows on the same side in the direction of extension of each nozzle row. The IC chip 26 which is elongate is disposed near the head 50 and at the side of the nozzle row 51*a* for yellow ink. A longitudinal side face of the IC chip 26 is adjacent to a longitudinal side face of the buffer tank 21, as shown in FIG. 3.

As shown in FIG. 3, a piezoelectric actuator unit 32 constituted by a piezoelectric element is disposed on a side of the head 50 remote from the nozzle surface 52, and at a position corresponding to the nozzle rows 51*a*-51*d*. In a left-side lower portion of a bottom part of the head holder 20 as seen in FIG. 3, there is formed a slit 33 extending along the direction of extension of each nozzle row 51*a*-51*d*, and a flexible flat cable 25 is inserted through this slit 33. The IC chip 26 and the piezoelectric actuator unit 32 are electrically connected through this flat cable 25. The flat cable 25 connected to the IC chip 26 extends through a space over the buffer tank 21 to be connected to a control circuit substrate 35 disposed over the buffer tank 21.

The IC chip 26 incorporates a drive circuit for outputting drive signals for driving the piezoelectric actuator unit 32. The drive circuit outputs the drive signals to the piezoelectric actuator unit 32 at timings corresponding to reception of control signals outputted from the control circuit substrate 35.

The IC chip 26 is placed on a plate 34 which is disposed on the bottom part of the head holder 20 and adjacent to the slit 33. The plate 34 is made of a material having elasticity such as rubber and resin, and has an upper face larger than an undersurface of the IC chip 26.

As shown in FIGS. 3 and 5, a heatsink 29 as a heat radiator for releasing heat generated at the IC chip 26 is attached on an upper face of the IC chip 26.

As shown in FIG. 2, the heatsink 29 comprises three integral planar parts, namely, a contact part 29*a*, a side part 29*b*, and an extending part 29*c*. The contact part 29*a* is formed in a horizontally long planar shape, and its undersurface contacts the upper face of the IC chip 26 and has an area sufficiently larger than that of the upper face of the IC chip 26, as shown in FIG. 5. The side part 29*b* extends perpendicularly upwardly from one of opposite longer edges of the contact part 29*a*, which is near a first inner surface 20*k* of the head holder 20. One of horizontally long opposite surfaces of the side part 29*b* is opposed to an outer surface of a side of a buffer tank 21, while the other of the opposite surfaces of the side part 29*b* faces the first inner surface 20*k* of the head holder 20. In other words, a cross section of the contact part 29*a* and side part 29*b* is L-shaped, as shown in FIG. 3. The side part 29*b* of the heatsink 29 is located, with spacing on its both sides, between the first inner surface 20*k* of the head holder 20 to which the heatsink 29 is attached, and the outer surface of the buffer tank 21. In the present embodiment, the side part 29*b* is disposed close to the first inner surface 20*k* but with a clearance therebetween, which allows insertion of the flat cable 25 extending from the IC chip 26 therethrough. On the other hand, the side part 29*b* is opposed to the outer surface of the buffer tank 21 with a space corresponding to a width of the contact part 29*a;* that is, a space defined by the contact part 29*a* as a bottom is formed between the side part 29*b* and the outer surface of the buffer tank 21.

The side part 29*b* extends farther than a longitudinal end of the contact part 29*a*, up to the vicinity of a corner where the first inner surface 20*k* of the head holder 20 meets a second inner surface 20*m* thereof, as shown in FIG. 2.

Referring to FIG. 4, the extending part 29*c* is formed in a horizontally long planar shape extending from an end 29*e* of the side part 29*b* and along the second inner surface 20*m*. The extending part 29*c* extends beyond the ink supply port 27*d* for black ink, with a longitudinal end 29*d* of the extending part 29*c* located on the farther side of the ink supply port 27*d* from the IC chip 26. A plane surface of the extending part 29*c* is near, and opposed to, a side surface 21*i* of the buffer tank 21 on the side of the ink supply ports.

In other words, the side part 29*b* is bent substantially at right angles to the side of the ink supply ports 27 to form the extending part 29*c*. When seen in a direction as presented in FIG. 4, the side part 29*b* and the extending part 29*c* form an L-shape, with a clearance between the extending part 29*c* and the buffer tank 21.

The contact part 29*a* has, at its opposite longitudinal ends, two attaching holes 29*x*, 29*y*. The heatsink 29 is fixed to the head holder 20 by inserting a fastener 20*b* through the attaching hole 29*x*, and another fastener (not shown) through the other attaching hole 29*y*. The IC chip 26 sandwiched between the plate 34 and the contact part 29*a* of the heatsink 29 is pressed against the undersurface of the contact part 29*a* by a pressing force of the plate 34, so that the contact part 29*a* and the IC chip 26 are held in close contact.

The heatsink 29 is made of a metallic material having a relatively high thermal conductivity, such as aluminum and an alloy mainly composed of aluminum.

As shown in FIG. 4, the side part 29*b* of the heatsink 29 as attached to the head holder 20 extends along the first inner surface 20*k* of the head holder 20 so as to cover a longitudinal side surface 21*h* of the buffer tank 21 via the space partially defined by the contact part 29*a*. The extending part 29*c* is disposed along the second inner surface 20*m* of the head holder 20 and near the ink-supply-port side surface 21*i* of the buffer tank 21 to cover the side surface 21*i*. The extending part 29*c* extends beyond a position corresponding to the ink supply port 27*d* for black ink, such that the end 29*d* of the extending part 29*c* is located near an end of a third inner surface 20*n* of the head holder 20. When seen from the side of the nozzle surface 52, the end 29*d* is positioned close to an end of the nozzle surface 52 in a width direction of the nozzle surface 52.

Referring to FIG. 4, heat generated in the IC chip 26 is transferred to the contact part 29*a* of the heatsink 29, and then to the extending part 29*c* via the side part 29*b*. In the course of this heat transfer, the heatsink 29 radiates heat. The heat radiated from the extending part 29*c* warms the ink supply ports 27, the ink-supply-port side surface 21*i*, and the inks flowing through the ink supply ports 27, all together. Therefore, the temperature at the ink supply ports 27 and its vicinity, where the temperature has not tended to rise conventionally, is raised by the warmed inks and the heat radiated from the extending part 29*c*, thereby making a temperature distribution in the head 50 uniform.

Effects of the First Embodiment (1) As has been described above, in the present inkjet recording apparatus 1, the heatsink 29 is formed such that at least a part thereof extends alongside and above the ink supply ports 27 disposed positionally correspondingly to the ends of the respective nozzle rows on the same side in the direction of extension of each nozzle row. Thus, it is enabled to warm an area along the ink supply ports 27 by the heat radiation of the heatsink 29.

That is, there is reduced a difference in temperature between the area corresponding to, or the vicinity of, the contact part of the heatsink 29 which is in contact with the IC chip 26, and the area corresponding to the extending part 29*c* of the heatsink 29 which extends alongside and above the ink supply ports 27.

Thus, an inkjet recording apparatus capable of reducing a variation in temperature at a region where nozzles are disposed is realized.

In addition, since at least a part of the heatsink 29 extends alongside and above the ink supply ports 27, a heat radiating area of the heatsink 29 from which heat is radiated is increased compared to the conventional arrangement, enhancing the efficiency of heat release.

(2) In particular, since the heatsink 29 is configured such that at least a part thereof extends alongside and above the ink supply ports 27, the area where the ink supply ports 27 are disposed can be warmed by the heat radiation from the heatsink 29.

That is, there is reduced the difference in temperature between the area corresponding to, or the vicinity of, the contact part 29*a* of the heatsink 29 contacting the IC chip 26, which is disposed on at least one of two sides of the nozzle rows opposite in the direction of the alignment of the nozzle rows, that is, in the direction perpendicular to the direction of extension of the nozzle rows, and the area corresponding to the extending part 29*c* of the heat sink which extends alongside and above the ink supply ports 27.

Thus, an inkjet recording apparatus capable of reducing a variation in temperature at a region where nozzles are disposed is realized.

Further, since at least a part of the heatsink 29 extends alongside and above the ink supply ports 27, the heat radiating area in the heatsink 29 is increased compared to the conventional arrangement, enhancing the efficiency of heat release.

(3) According to the above-described embodiment, there is reduced a temperature variation among areas where the nozzle rows, which are for ejecting droplets of the inks of respective colors, are respectively disposed. Thus, the recording quality can be improved where a plurality of color inks are used.

(4) Furthermore, since the plate 34 is interposed between the bottom of the head holder 20 and the heatsink 29 with the IC chip 26 pressed by the plate 34 against the heatsink 29, the IC chip 26 and the heatsink 29 are held in close contact with each other.

Hence, unlike the arrangement where a non-contact portion or a clearance is present between the heat sink 29 and the IC chip 26, the contact between the heatsink 29 and the IC chip 26 is ensured with reliability, improving the transfer of the heat generated at the IC chip 26 to the heatsink 29, and, as a whole, further enhancing the efficiency of heat radiation of the heatsink 29.

Second Embodiment

Figure 6:
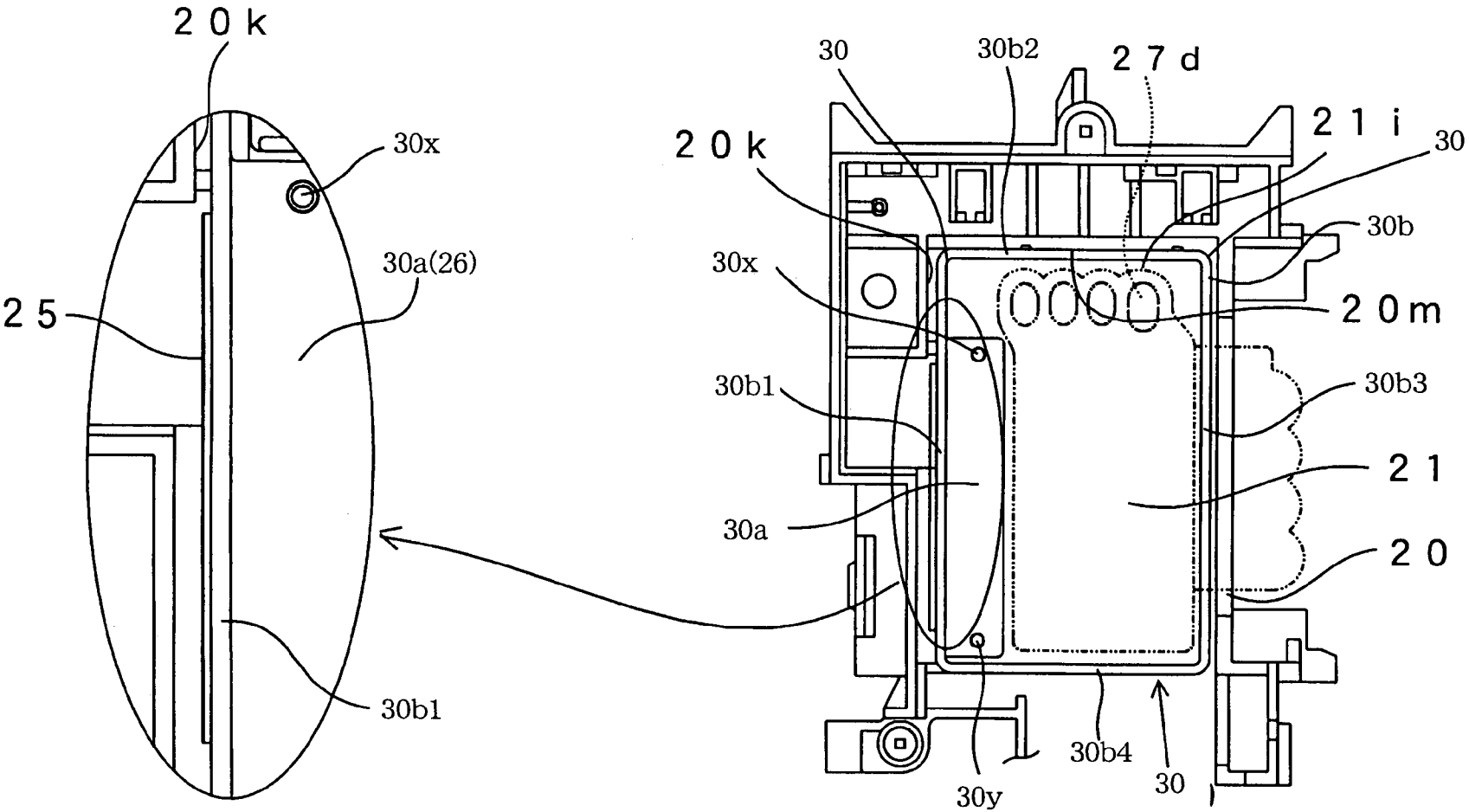
FIG. 6 is a plan explanatory view showing a state where a heatsink of an inkjet recording apparatus according to a second embodiment of the invention is mounted on an inkjet head, as seen from the side of a buffer tank.

Referring now to FIG. 6, there will be described a second embodiment of the invention. FIG. 6 is a plan explanatory view showing a state where a heatsink of an inkjet recording apparatus according to the second embodiment is disposed in a head unit, as seen from the side of a buffer tank. Since a structure of the inkjet recording apparatus of the second embodiment is identical with that of the first embodiment, except the shape of the heatsink, description of the identical part is dispensed with, and the same parts or elements are denoted by the same reference numerals as used in the first embodiment.

A heatsink 30 of the second embodiment comprises a planar contact part 30*a* contacting the IC chip 26 and a rectangular frame part 30*b*, which are integrally formed. The frame part 30*b* comprises four parts 30*b*1, 30*b*2, 30*b*3, 30*b*4 which are integrally formed to encircle an entire circumference of a buffer tank 21, and each of which is planar. One of the planar parts which extends perpendicularly upwardly from one of opposite longitudinal edges of the contact part 30*a*, which is near a first inner surface 20*k* of the head holder 20, will be referred to as an "elongate" part 30*b*1, and the other planar parts 30*b*2, 30*b*3, 30*b*4 will be referred to as "extending" parts. Hereinafter, the space surrounded by the frame part 30*b* will be referred to as an "inner" side. The elongate part 30*b*1 extends beyond an end of the contact part 30*a*, up to the vicinity of a corner where the first inner surface 20*k* of the head holder 20 meets a second inner surface 20*m* thereof.

An inner plane surface of the elongate part 30*b*1 is opposed to a side surface of the buffer tank 21 which extends in the longitudinal direction of the buffer tank 21 on the side of the yellow ink nozzle row 51*a*, which is the nearest an IC chip 26 among all of the nozzle rows, as shown in FIG. 5. A first extending part 30*b*2 is formed in a horizontally long planar shape extending from an end 29*e* of the elongate part 30*b*1 along the second inner surface 20*m*, similarly to the first embodiment. The first extending part 30*b*2 extends beyond an ink supply port 27*d* for black ink, with a longitudinal end 29*d* of the first extending part 30*b*2 positioned on the farther side of the ink supply port 27*d* from the IC chip 26. An inner plane surface of the first extending part 30*b*2 is opposed to a side surface 21*i* of the buffer tank 21 on the side of ink supply ports 27.

The second extending part 30*b*3 is formed in the same shape as the elongate part 30*b*1, and disposed to be opposed to the elongate part 30*b* 1. An inner plane surface of the second extending part 30*b*3 is opposed to a side surface of the buffer tank 21 which extends in the longitudinal direction of the buffer tank 21 on the side of a nozzle row 51*d* for black ink, which is the most remote from the IC chip 26 among all the nozzle rows, as illustrated in FIG. 5. The third extending part 30*b*4 is formed in the same shape as the first extending part 30*b*2, and disposed to be opposed to the first extending part 30*b*2. An inner plane surface of the third extending part 30*b*4 is opposed to one of opposite side surfaces of the buffer tank 21 on its shorter sides which is distant from the ink supply ports 27. In other words, the heatsink 30 is attached to the head holder 20 such that the parts of the heatsink 30 other than the contact part 30*a*, namely, the elongate part 30*b*1 and the extending parts 30*b*2, 30*b*3, 30*b*4 constituting the frame part 30*b*, are adjacent to respectively corresponding side surfaces of the buffer tank 21. In the second embodiment also, a space whose bottom is defined by the contact part 30*a* is formed between the elongate part 30*b*1 and a side surface of the buffer tank 21 which extends in the longitudinal direction of the buffer tank 21, similarly to the first embodiment.

Heat generated at the IC chip 26 is transferred to the contact part 30*a*, and then, via the elongate part 30*b*1 and the first and second extending parts 30*b*2, 30*b*4, to the third extending part 30*b*4. In the course of this heat transfer, the heatsink 30 radiates the heat, and the ink supply ports 27, the ink-supply-port side surface 21*i*, and inks flowing through the ink supply ports 27 are warmed all together. Accordingly, in addition to the extending part 30*b*2 on the side of the ink supply ports 27, the second extending part 30*b*3 also functions to warm. That is, the second extending part 30*b*3 warms an area corresponding to the nozzle row 51*d* for black ink which is the farthest from the IC chip 26 among all of the nozzle rows. Further, since a space partially defined by the contact part 30*a* is formed between the elongate part 30*b*1 and the buffer tank 21, while a side surface of the buffer tank 21 opposite the ink-supply-port side surface 21*i* is also warmed by the extending part 30*b*4 disposed adjacent to the buffer tank 21, the buffer tank 21 is warmed relatively uniformly from the entire circumference of the buffer tank 21.

Hence, the ink supply ports 27 and its vicinity where the temperature has not tended to rise conventionally can be easily warmed, contributing to improving the uniformity in the temperature distribution in a head 50.

Since the heatsink 30 comprises not only the first extending part 30*b*2 on the side of the ink supply ports 27 but also the third extending part 30*b*4 opposite the first extending part 30*b*2, and the second extending part 30*b*3 positionally corresponding to the nozzle row 51*d* for black ink, the heat radiating area is increased compared to the arrangement where only the extending part 30*b*2 on the side of the ink supply ports 27 is provided. Thus, the efficiency of heat release is further enhanced, thereby preventing the temperature at the region where nozzles are disposed, and particularly at the area where the nozzle row 51*a* for yellow ink which is the nearest the IC chip 26 among all of the nozzle rows, from rising significantly higher than the other areas.

That is, the temperature at the area where the nozzle row 51*a* for yellow ink is disposed, which has tended to rise conventionally, is prevented from rising, while the temperature at the area along the ink supply ports 27 and at the nozzle row 51*d* for black ink and its vicinity, which has not tended to rise conventionally, is raised. Therefore, the variation in temperature in the region where the nozzles are disposed is reduced.

Effects of the Second Embodiment (1) As described above, in the inkjet recording apparatus where the heatsink 30 extends, via the place where the ink supply ports 27 are disposed, beyond the nozzle row 51*d* for black ink which is the farthest from the IC chip 26 among all of the nozzle rows, there can be warmed an area corresponding to a path extending alongside and above the ink supply ports 27 and the nozzle row 51*d* for black ink.

That is, there is reduced a difference in temperature between the area corresponding to, or the vicinity of, the contact part 30*a* of the heatsink 30 which is in contact with the IC chip 26, and the area corresponding to the above-mentioned path.

(2) Since the heatsink 30 extends via the place where the ink supply ports 27 are disposed, up to alongside and above the nozzle row 51*d* for black ink which is the farthest from the IC chip 26 among all of the nozzle rows, the heat radiating area of the heatsink 30 is increased compared to the arrangement where the heatsink 30 merely extends alongside and above the ink supply ports 27. Thus, the efficiency of heat release is further enhanced.

(3) Since the inkjet recording apparatus of the second embodiment is identical with that of the first embodiment, except that the heatsink 30 extends alongside and above the nozzle row 51*d* for black ink which is the farthest from the IC chip 26 among all of the nozzle rows 51, the above-stated effects (3) and (4) of the first embodiment can be obtained according to the second embodiment also.

It is not essential that the frame part 30*b* is fully continuous, but the frame part 30*b* may have an opened portion or gap. A heatsink 30 having such a gap can be produced by bending a sheet or plate material, which method requires a reduced manufacturing cost.

Third Embodiment

Figure 7:
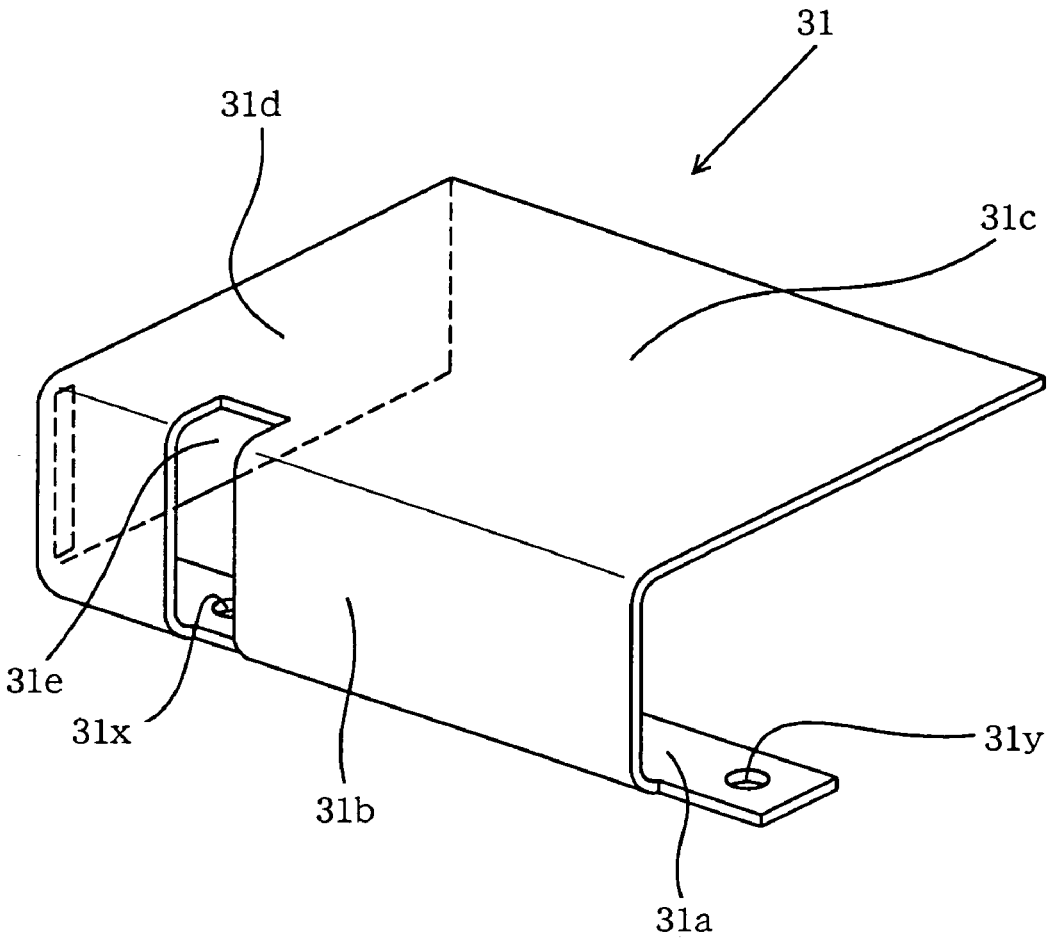
FIG. 7 is a perspective explanatory view of a heatsink of an inkjet recording apparatus according to a third embodiment of the invention.
Figure 8:
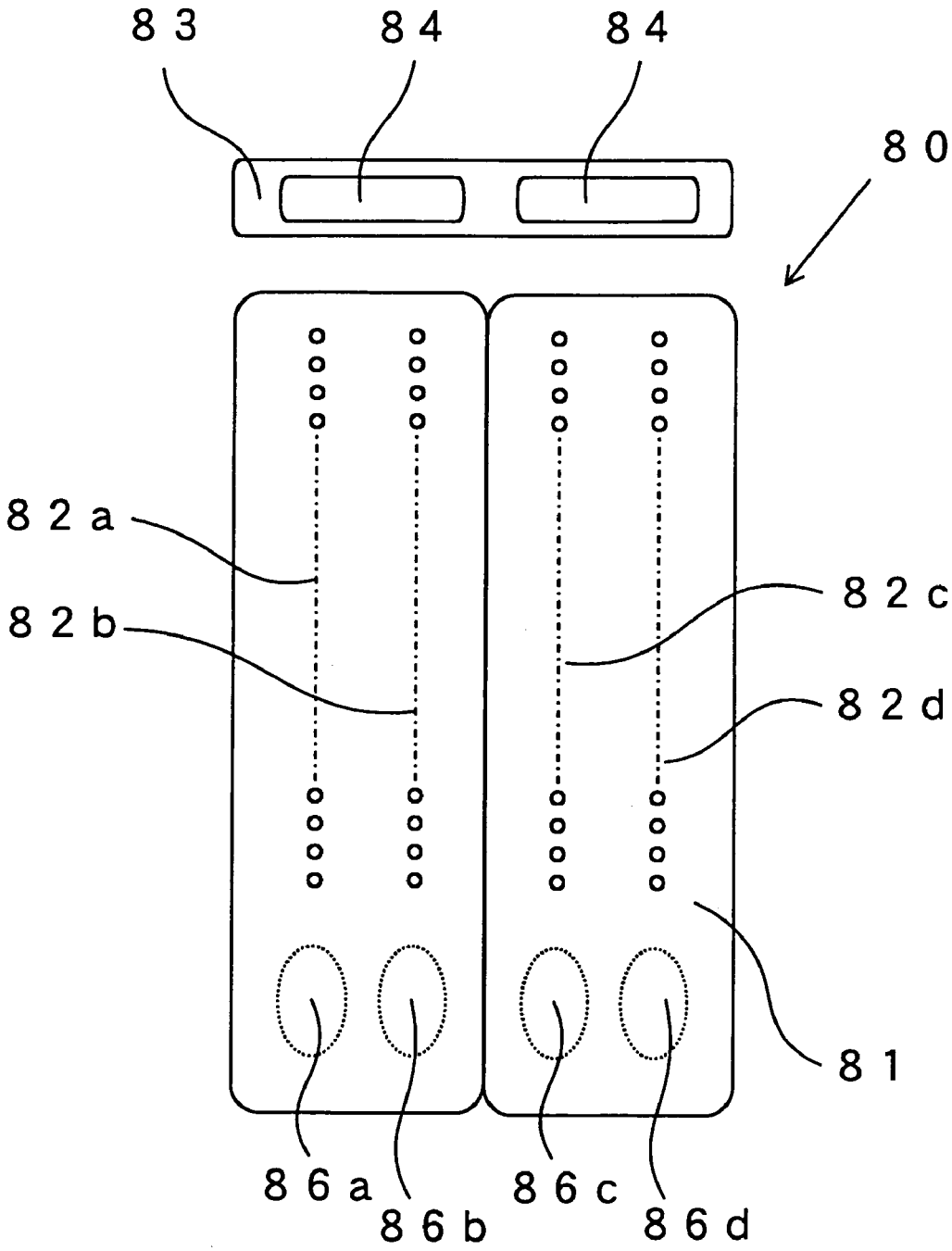
FIG. 8 is an explanatory view showing a positional relationship between an inkjet head and an IC chip of the conventional inkjet recording apparatus.

Referring now to FIG. 7, there will be described a third embodiment of the invention. FIG. 7 is a perspective view of a heatsink 31 of an inkjet recording apparatus according to the third embodiment. The heatsink 31 is formed in the shape of a cover having an opening from which a buffer tank 21 is inserted to be positioned. The heatsink 31 comprises a contact part 31*a*, a side part 31*b*, a first extending part 31*c*, and the second extending part 31*d*. The contact part 31*a* is in contact with the IC chip 26, and the side part 31*b* perpendicularly upwardly extends from one of opposite longitudinal edges of the contact part 31*a* which is on the side of an inner surface of a head holder 20. The first extending part 31*c* extends from a longitudinally extending upper end of the side part 31*b*, so as to cover an upper surface of the buffer tank 21 from the upper side. The second extending part 31*d* extends from an end of the first extending part 31*c* on the side of ink supply ports 27, toward the ink supply ports 27. The side part 31*b* and the second extending part 31*d* are disposed along inner surfaces 20*k*, 20*m* (FIG. 6) of the head holder 20, respectively. The first extending part 31*c* is formed in a size to cover almost the entirety of the upper surface of the buffer tank 21, while the second extending part 31*d* has a size to cover almost the entirety of an ink-supply-port side surface 21*i* of the buffer tank 21. In the contact part 31*a*, there are formed attaching holes 31*x*, 31*y*. The heatsink 31 further has a cutout 31*e* so that a work operation of fixing the heatsink 31 can be performed from the side of the first extending part 31*c*.

Effects of the Third Embodiment (1) In the inkjet recording apparatus where the heatsink 31 covers almost the entirety of the upper surface of the buffer tank 21 from the upper side, the inks in the buffer tank 21 can be warmed through the covered portion of the buffer tank 21. The heat radiated from the heatsink 31 can thus warm the inks to be supplied to the nozzle rows, reducing the variation in the ink ejection performance from nozzle to nozzle due to the variation in the ink temperature.

(2) Since the second extending part 31*d* extends alongside and above the ink supply ports 27 disposed positionally correspondingly to the ends of the respective nozzle rows on the same side in the direction of extension of each nozzle row, the area along the ink supply ports 27 can be warmed by the heat radiated from the second extending part 31*d*, thereby reducing a difference in temperature between the area corresponding to, or the vicinity of, the contact part 31*a* of the heatsink 31 which is in contact with the IC chip 26, and the area corresponding to the second extending part 31*d* alongside and above the ink supply ports 27.

(3) Since the inks in the buffer tank 21 draw the heat radiated from the heatsink 31 through the portion of the buffer tank 21 covered by the heatsink 31, the efficiency of heat release by the heatsink 31 can be enhanced.

(4) Further, since the inkjet recording apparatus of the third embodiment is identical with that of the first embodiment, except the presence of the first extending part 31*c*, the above-stated effects (3) and (4) of the first embodiment can be obtained according to the third embodiment also.

Other Embodiments

The present invention may be otherwise embodied with various changes and modifications which may occur to those skilled in the art, without departing from the spirit and scope of the invention. Hereinafter there will be described some of such modifications to the above-described embodiments.

(1) The IC chip 26 may be disposed at any other positions. For instance, it may be arranged such that an IC chip is disposed at the side of the nozzle row 51*d* for black ink, or at the side of the ink supply ports 27, and a heatsink 31 is disposed correspondingly to the position of the IC chip. Even where such an arrangement is employed, the area along the ink supply ports 27 can be warmed by the heatsink 31, achieving the same effects as obtained by the above-described embodiments.

(2) Each part 29*b*, 30*b*1, 30*b*2, 30*b*3, 30*b*4, 31*b*, 31*c*, 31*d* of the heatsink 29, 30, 31 may have a shape other than the planar shape as mentioned above. For instance, the extending part 30*b*2 may have a corrugated shape in cross section. When such a corrugated part 30*b*2 is employed, the surface area of the heatsink increases, enhancing the efficiency of heat release and accordingly the efficiency of warming of the area along the ink supply ports 27. Further, the height of the extending part 30*b*2 may be increased at a portion near the supply port 27*d* for black ink, so that the amount of heat radiated at the position corresponding to this supply port 27*d* for black ink becomes larger than at the positions corresponding to the other supply ports for inks of the other colors. When this arrangement is employed, the supply port 27*d* for black ink and its vicinity, where the temperature tends to decrease due to a relatively large amount of ink flow therethrough, is particularly efficiently warmed, further reducing the variation in temperature in the region where the nozzles are disposed.

(3) The extending part 30*b*2 may be formed in any length as long as the extending part 30*b*2 extends alongside and above the ink supply ports 27 so as to warm the area along the ink supply ports 27.

Further, to obtain the effects of the third embodiment, the first extending part 31*c* of the third embodiment may have any size as long as the extending part 31*c* covers at least a part of the upper surface of the buffer tank 21 so as to warm the inks in the buffer tank 21 via the covered portion.

(4) In the third embodiment, there may be provided an additional planar part extending perpendicularly downwardly from one of opposite longitudinal ends of the first extending part 31*c*, which is remote from the side part 31*b*, such that the additional planar part is opposed to the side part 31*b*. Where such an arrangement is employed, since the additional planar part extends above and alongside the nozzle row 51*d* for black ink to warm the nozzle row 51*d* not only from the upper side but also from a side thereof with respect to its extending direction, the temperature at the area corresponding to the nozzle row 51*d* is easily raised. Thus, there is reduced a difference in temperature between the area corresponding to the nozzle row 51*d* for black ink and the area corresponding to the nozzle row 51*a* for yellow ink, which is the nearest the IC chip 26.

The piezoelectric actuator unit 32, the recording sheet P, the IC chip 26, the heatsink 31 may constitute an actuator, a recording medium, a drive element, and a heat radiating member, respectively, while the buffer tank 21 and the ink supply ports 27 may constitute an ink supply portion. Further, the plate 34 may constitute an elastic member.

What is claimed is:

1. An inkjet recording apparatus comprising:

a head having an actuator and a plurality of nozzle rows each of which comprises a plurality of nozzles for ejecting an ink droplet therethrough onto a recording medium by driving the actuator;

a drive element which outputs to the actuator a drive signal for ejecting the ink droplet;

an ink supply portion including a plurality of ink lead passages which are arranged in a first direction, extend in a second direction intersecting the first direction, and are connected to the plurality of nozzle rows of the head, respectively, so as to supply at least one sort of ink to the head;

a heat radiating member which has a contact portion including a contact surface that is in contact with the drive element and an extending portion including an extending surface that is distinct from the contact surface such that the extending surface and the contact surface are not in the same plane, wherein the extending surface extends, in the first and second directions, alongside at least the ink lead passages of the ink supply portion, so as to release heat generated at the drive element; and a head holder which holds the head, the drive element, the ink supply portion, and the heat radiating member.

2. The inkjet recording apparatus of claim 1, wherein the extending portion includes a first part and a second part, the first part extending alongside the plurality of ink lead passages of the ink supply portion each of which is near the head relatively to a corresponding one of a plurality of compartments of the ink supply portion alongside which the second part extends, such that the each ink lead passage and the one compartment of the ink supply portion intersect each other.

3. The inkjet recording apparatus of claim 1, wherein each of the ink lead passages of the ink supply portion comprises a head connecting side on which side the each ink lead passage is connected to the head, the head connecting side of the each ink lead passage positionally corresponding to one of opposite ends of a corresponding one of the nozzle rows, and the extending portion is disposed alongside the respective head connecting sides of the ink lead passages of the ink supply portion.

4. The inkjet recording apparatus of claim 1, wherein at least a part of the nozzle rows are for ejecting inks of respective colors, different from row to row, and at least a part of the ink lead passages are connected to at least the part of the nozzle rows, respectively, so as to supply the inks of different colors, respectively.

5. The inkjet recording apparatus of claim 1, further comprising an elastic member disposed between a portion of the head holder and the drive element, and wherein the drive element is pressed against the heat radiating member by the elastic member.

6. The inkjet recording apparatus of claim 1, wherein the ink supply portion comprises a buffer tank.

7. The inkjet recording apparatus of claim 1, further comprising a flexible flat cable which is inserted through a slit formed in the head holder to electrically connect the actuator and the drive element to each other.

8. The inkjet recording apparatus of claim 1, wherein the heat radiating member is made of aluminum or an alloy mainly composed of aluminum.

9. The inkjet recording apparatus of claim 1, wherein the heat radiating member is spaced from the head and the ink supply portion so as not to contact the head and the ink supply portion.

10. The inkjet recording apparatus of claim 1, further comprising a flexible flat cable which electrically connects the actuator of the head to the drive element, so that the heat radiating member is spaced from the head and the ink supply portion and is not contacted with the head and the ink supply portion.

11. The inkjet recording apparatus of claim 1, wherein the nozzle rows extend in a third direction, wherein the ink lead passages of the ink supply portion are arranged in the first direction perpendicular to the third direction, and extend in the second direction perpendicular to the first and third directions, and wherein the extending portion includes a planar part having the extending surface which extends, in the first and second directions, alongside at least the ink lead passages the ink supply portion.

12. The inkjet recording apparatus of claim 2, wherein the drive element is disposed on at least one of two opposite sides of the nozzle rows which are opposite in the first direction perpendicular to a third direction in which the each nozzle row extends, wherein the ink supply portion comprises a buffer tank which stores the at least one sort of ink to be supplied to the head and is disposed on a side of the head holder opposite to a side on which the nozzles are arranged in the head, and the buffer tank has a head connecting side on which side the buffer tank is connected to the head, the head connecting side of the buffer tank positionally corresponding to one of opposite ends of the each nozzle row, wherein the buffer tank has two opposite surfaces that are substantially parallel to the head, such that one of the two opposite surfaces is remote from the head, wherein the first part of the extending portion extends alongside the head connecting side of the buffer tank, and wherein the second part of the extending portion covers at least a part of the one surface of the buffer tank remote from the head.

13. The inkjet recording apparatus of claim 2, wherein each of the ink lead passages of the ink supply portion comprises a head connecting side on which side the each ink lead passage is connected to the head, the head connecting side of the each ink lead passage positionally corresponding to one of opposite ends of a corresponding one of the nozzle rows, and wherein the first part of the extending portion is disposed alongside the respective head connecting sides of the ink lead passages of the ink supply portion.

14. The inkjet recording apparatus of claim 2, wherein the ink supply portion comprises a buffer tank which stores the at least one sort of ink to be supplied to the head, and is disposed on a side of the head holder opposite to a side on which the nozzles are arranged in the head, wherein the buffer tank has two opposite surfaces that are substantially parallel to the head, such that one of the two opposite surfaces is remote from the head, and wherein the second part of the extending portion covers at least a part of the one surface of the buffer tank.

15. The inkjet recording apparatus of claim 3, wherein the drive element is disposed on at least one of two opposite sides of the nozzle rows which are opposite in the first direction perpendicular to a third direction in which the each nozzle row extends, and the extending portion extends from the contact portion alongside the respective head connecting sides of the ink lead passages of the ink supply portion.

16. The inkjet recording apparatus of claim 10, wherein the actuator comprises a piezoelectric actuator.

17. The inkjet recording apparatus of claim 13, wherein the drive element is disposed on at least one of two opposite sides of the nozzle rows which are opposite in the first direction perpendicular to a third direction in which the each nozzle row extends, and the first part of the extending portion extends from the contact portion alongside the respective head connecting sides of the ink lead passages of the ink supply portion.

18. The inkjet recording apparatus of claim 15, wherein the first part further extends alongside one of the nozzle rows which is located on a side thereof remote from the drive element.

19. The inkjet recording apparatus of claim 15, wherein the first part further extends alongside one of the nozzle rows which is the farthest from the drive element among all of the nozzle rows.

* * * * *